United States Patent [19]

Knight

[11] 4,396,398

[45] Aug. 2, 1983

[54] ANTIMISTING ADDITIVES FOR AVIATION FUELS

[75] Inventor: John Knight, Farnborough, England

[73] Assignee: The Secretary of State for Defence in Her Britannic Majesty's Government of the United Kingdom of Great Britain and Northern Ireland, London, England

[21] Appl. No.: 305,736

[22] Filed: Sep. 25, 1981

[30] Foreign Application Priority Data

Oct. 1, 1980 [GB] United Kingdom ..... 8031640

[51] Int. Cl.[3] ..... C10L 1/18

[52] U.S. Cl. ..... 44/56; 44/62; 44/70; 44/66; 44/77

[58] Field of Search ..... 44/56, 62, 70; 526/317; 44/66, 77

[56] References Cited

U.S. PATENT DOCUMENTS

| | | | |
|---|---|---|---|
| 2,726,942 | 12/1955 | Arkis et al. | 44/56 |
| 2,936,223 | 5/1960 | Lovett et al. | 44/56 |
| 3,687,644 | 8/1972 | Delafield et al. | 44/56 |
| 3,792,984 | 2/1974 | Cole et al. | 44/62 |
| 3,803,034 | 4/1974 | Gaydasch | 44/62 |
| 3,812,034 | 5/1974 | Gaydasch | 44/62 |
| 3,846,090 | 11/1974 | Osmond et al. | 44/62 |
| 3,846,091 | 11/1974 | Osmond et al. | 44/62 |
| 4,292,045 | 9/1981 | Brooks et al. | 44/62 |
| 4,334,891 | 6/1982 | Brooks et al. | 44/62 |

*Primary Examiner*—Charles F. Warren
*Assistant Examiner*—Y. Harris-Smith
*Attorney, Agent, or Firm*—Cushman, Darby & Cushman

[57] ABSTRACT

A method for dissolving in a liquid, mainly aliphatic, hydrocarbon fuel having a flash point not less than 90° F. an additive comprising:

(a) a specified polymer;

(b) a specified hydroxylic carrier liquid for the polymer;

(c) a specified amine;

the concentration of the polymer in the fuel being in the inclusive range from 0.05% to 1% by weight, wherein the improvement comprises additionally adding to the fuel an additional component comprising one or more compounds selected from the following to improve dissolution of the additive in the fuel:

(i) water: to an extent of from 0.1% to 1.25% by weight of the additive plus the additional component;

(ii) glycerol: to an extent of from 0.1% to 1.25% by weight of the additive plus the additional component;

(iii) ethylene glycol: to an extent of from 0.1% to 2% by weight of the additive plus the additional component; and (iv) carboxylic acid, preferably formic or acetic acid, to an extent of from 10% to 200% molar equivalent of the amount of amine present.

12 Claims, 2 Drawing Figures

DISSOLUTION TIME (min.)
32
28
24
20
16
12
8
4
0
0·5
1
1·5
2
% OF WATER IN PASTE
0°C
20°C

ANTIMISTING ADDITIVES FOR AVIATION FUELS

The present invention relates to anti-misting additives for aviation fuels.

Aviation fuel is a highly flammable liquid which in the event of an aircraft crash or other shock presents a very great fire hazard to the aircraft and its environment, particularly if the fuel tanks of the aircraft are ruptured by the shock. In such circumstances fuel spills from the tanks and tends to disperse rapidly in the air flow over the aircraft and form a mist of tiny fuel droplets. Such a fuel/air mixture is readily ignited by sparks, hot surfaces, or other ignition sources.

Although it is not always possible to prevent fuel spillage in the event of a shock, the likelihood of a fuel fire breaking out may be greatly reduced by reducing the tendency of the fuel to form ignitable mists under the above conditions. This may be achieved by incorporating in the fuel an anti-misting additive.

In British Patent Specification No. 1,384,536 a method of dissolving a polymer in a liquid hydrocarbon fuel having a flash point not less than 90° F. is described, characterised in that a specified polymer is added to an organic liquid in which the polymer is insoluble but with which the fuel is miscible and is then admixed with the liquid hydrocarbon fuel. Suitable liquids to which the polymer may be added according to that Specification, include polar liquids such as alcohols and glycols where the liquid fuel consists mainly of an aliphatic hydrocarbon. The purpose of dissolving the polymer in the liquid fuel is that of reducing the tendency of the fuel to form a readily ignitable mist under shock conditions such as those encountered in an aircraft crash as described above. There are, however, substantial practical problems in dissolving the requisite proportion of polymer (say 0.1–1.0% by weight) in the large quantities of fuel which are handled and consumed in everyday aircraft operation.

One method of mixing the polymer with the fuel is to introduce it in a single operation in the course of the actual loading of the fuel into the aircraft. If the polymer is to be introduced in this way, it is necessary to achieve rapid dissolution of the polymer in view of the high flow rate at which refuelling is normally carried out. The method of British Specification No. 1,384,536 provides an answer to these problems which is applicable in many cases, the pre-mixing of the polymer with the polar liquid affording a significant enhancement of the rate of dissolution of the polymer in the fuel.

When the method of British Specification No. 1,384,536 is applied to the dissolution of certain polymers in, say, aviation kerosene, using a hydroxylic liquid as the polar liquid, the dissolution of the polymer is acceptably rapid but the anti-misting properties of the treated fuel thus obtained are inferior to those of the same fuel in which the same copolymer has been dissolved by the more time-consuming method of stirring the polymer into the fuel in the absence of any hydroxylic liquid. Polymers which behave in this way include the copolymers of tertbutylstyrene which are described and defined in British Patent Specification No. GB 2045778A.

The anti-misting properties of the fuel treated according to Specification No. 1,384,536 can be restored substantially to the same level as, or even a higher level than, that attained when the hydroxylic carrier liquid is omitted, by dissolving an amine compound in the fuel so treated as described in UK Patent Specification No. GB 2048937A.

Preferably, the amine is added to the hydroxylic carrier liquid and the polymer to form a single additive which may be added in a 'one-shot' operation to the fuel.

The main purpose of the present invention is to provide an improvement in the rate of dissolution of the polymer in the fuel in the case where the polymer, hydroxylic carrier liquid and amine are all pre-mixed and the resulting additive mixture is then blended with the fuel in a 'one-shot' modification.

According to the present invention a method for dissolving in a liquid, mainly aliphatic, hydrocarbon fuel having a flash point not less than 90° F. an additive comprising a polymer as defined below in finely divided form, a hydroxylic carrier liquid as defined below and an amine as defined below, the concentration of the polymer in the fuel being in the inclusive range from 0.05% to 1% by weight, is characterised in that there is present in the fuel after the additive has been blended into it an additional component comprising one or more compounds selected from the following:

- water: to an extent of from 0.1% to 1.25% by weight of the additive plus additional component;
- glycerol: to an extent of from 0.1% to 1.25% by weight of the additive plus additional component;
- ethylene glycol- to an extent of from 0.1% to 2% by weight of the additive plus additional component; and
- carboxylic acid: to an extent of from 10% to 200% molar equivalent of the amount of amine present.

The "additive" in the method according to the present invention is the polymer plus hydroxylic carrier liquid plus amine.

The additional component is most conveniently incorporated as part of a single carrier liquid mixture comprising the hydroxylic carrier liquid, amine and additional component, this liquid mixture being added to the polymer to form the following four-component composition:

| | |
|---|---|
| polymer | |
| hydroxylic carrier liquid<br>amine<br>additional component | premixed liquid |

This composition is then blended into the fuel.

Preferred carboxylic acids for use in or as the additional component are straight-chain aliphatic carboxylic acids having from 1 to 4 carbon atoms, particularly formic acid and acetic acid.

The preferred compound, for use in or as the additional component, selected from those listed above is water to an extent of about 0.5% by weight of the said composition weight, preferably together with formic acid to an extent of about 40% molar equivalent of the amine.

It has been found that incorporation of the additional component as specified above in the method according to the present invention gives improvement in the rate of dissolution of the additive comprising the polymer as defined, the hydroxylic carrier liquid as defined and amine as defined in the fuel specified.

The additional component can also improve the compatibility of the fuel so modified with an aircraft fuel system.

Before the fuel so modified can be burned efficiently by the engines of the aircraft and before it can be passed under realistic conditions through the various filters in the aircraft fuel system, the polymer as defined needs to be mechanically degraded, to reduce its molecular weight, in a known way. When the additive comprising polymer, hydroxylic carrier liquid, and amine is blended into the fuel the ease with which the polymer component of the additive may be mechanically degraded varies with time, especially within the first hour after blending, whether or not the additional component is also present in the freshly-made blend. The ease with which the polymer in the fuel may be mechanically degraded may be assessed by measuring, for a given energy input per unit volume of modified fuel, the ease with which it passes through a specified filter at a fixed temperature. In particular, it has been found that incorporation of the additional component as specified above in the method according to the present invention can also lead to more degradation of the polymer for a given energy input, especially within the first few hours after blending. This effect is of practical interest since such a freshly-made blend of polymer in fuel may need to be so degraded in an aircraft fuel system commencing about 15 minutes after blending, an interval compatible with most aircraft refuelling schedules.

Preferably, the fuel modified by the method according to the present invention has an aromatic content not less than 10% by volume.

The polymers to which the method of the present invention is applicable, which are referred to herein as polymers "as defined", are as follows. They comprise a copolymer of (i) at least 75% by weight of tert-butylstyrene, (ii) from 1% to 24% by weight of a second monomer selected from the acrylic and methacrylic esters of aliphatic monohydric alcohols containing from 1 to 4 carbon atoms, 2-ethoxyethyl methacrylate. acrylonitrile, vinyl acetate, styrene and vinyltoluene, and (iii) from 1% to 10% by weight of methacrylic acid, the aggregate of monomers (i), (ii) and (iii) being 100%, the copolymer having the following characteristics:

(a) it is soluble in AVTUR 50 aviation kerosene;

(b) a 0.3% by weight solution of the polymer in AVTUR 50 aviation kerosene has a relative viscosity in the range 1.25 to 2.6 and a differential orifice flow rate in the range 2.5 to 7 ccs per 30 seconds.

By "soluble in AVTUR 50" is meant that solutions of the polymer in AVTUR 50, at all concentrations in the range 0.05% to 1% by weight, are, notwithstanding that they may appear hazy or opalescent, nevertheless homogeneous in the sense that no gross separation from them of a swollen polymer phase occurs on standing for 24 hours at 20° C.

By "AVTUR 50" in this specification is meant a liquid hydrocarbon fuel complying with UK Government Specification D. Eng. RD 2494 (NATO Code No F-35) and having a flash point not lower than 100° F. and of 18 volume percent aromatic content. AVTUR 50 normally has a viscosity of 1.0–1.5 cps at 25° C.

By "relative viscosity" is meant the ratio of (i) the viscosity of the 0.3% by weight polymer solution in AVTUR 50 when measured by the method of British Standard No. 188:1937 "The Determination of the Viscosity of Liquids in CGS Units", Part 2, using a U-tube viscometer, Size A, at 25° C. to (ii) the viscosity of AVTUR 50 when measured under those same conditions.

By "differential orifice flow rate" is meant the difference between (a) the flow rate of a 0.3% by weight solution of the copolymer in AVTUR 50 through a passage of circular cross section having a square-edged orifice, the passage having a length of 0.062 inches and a diameter of 0.025 inches, and (b) the flow rate through the same said passage of a Newtonian liquid having the same viscosity as that of the copolymer solution referred to in (a) when the said viscosities are measured by the method of British Standard No 188:1937, the flow rates being expressed as the volume of liquid in ccs which passes through the orifice during the second period of 30 seconds of flow. Apparatus suitable for carrying out the differential orifice flow rates determination may be constructed by appropriately modifying a type A cup according to British Standard No. 1733.

The hydroxylic carrier liquid which is added to the polymer as defined above to form a blend for use in the method of the present invention, which is referred to herein as a hydroxylic carrier liquid "as defined", is as follows. It is a hydroxylic liquid which does not dissolve the polymer as defined or is at most only a weak swellant for the polymer in the sense that a mixture of the polymer in the particulate state with the hydroxylic carrier liquid together with n-butylamine at a concentration of 3% by weight of the polymer weight has a paste-like, rather than a rubber-like, consistency, even after prolonged storage at 20° C. The hydroxylic liquid must, at the same time, be miscible with the liquid fuel to the extent of at least 1% by weight and must not significantly lower its flash point. Suitable hydroxylic liquids satisfying these requirements include aliphatic monohydric and dihydric alcohols; more particularly propanol and 2-methoxyethanol amongst the monohydric alcohols and 2-methyl-pentane-2:4-diol and diethylene glycol amongst the dihydric alcohols. In general, the suitability of a given hydroxylic liquid may be determined by simple experimental tests of its swelling power for the polymer and its miscibility with the liquid fuel. However, where the liquid fuel is an aviation kerosene such as AVTUR 50, Jet A or a similar fuel, it is found that a preferred hydroxylic liquid is 2-methylpentane-2:4-diol. If desired, a mixture of two or more suitable compounds may be employed instead of a single compound as the hydroxylic carrier liquid.

The amine for use in the method according to the present invention, herein referred as the amine "as defined", comprises one or more amines selected from the following:

(i) the alkyl mono-amines containing from 1 to 12 carbon atoms, preferably primary in character. Examples of suitable members of this class include methylamine, ethylamine and n-butylamine;

(ii) alkanolamines containing 2 to 10 carbon atoms such as ethanolamine, diethanolamine and tripropanolamine; and (iii) heterocyclic amines such as piperidine and morpholine.

The preferred amines are the primary aliphatic amines containing from 3 to 10 carbon atoms, in particular n-butylamine.

The amount of amine as defined should preferably be in an amount from 0.01 to 0.2 mole based on each 100 grams of the polymer taken. The amount is preferably greater than 0.01 mole per 100 g of polymer taken in order to ensure that the liquid fuel being treated develops a satisfactory degree of resistance to misting under shock conditions. In the presence of any smaller proportion than this of the amine, or in its complete absence, admixture of the additive with the fuel results in dissolution of the polymer but the anti-misting properties of the solution are relatively slight. The optimum amount of amine will normally lie significantly above this lower limit, but below the upper limit previously stated of 0.2 mole per 100 g of the polymer.

If a composition is formed (for 'one-shot' modification of fuel) comprising the polymer as defined above added to a liquid mixture comprising hydroxylic carrier liquid as defined above, the amine as defined above and the additional component as defined above, then the polymer, in finely divided form, may be blended with the liquid mixture in any suitable way, for example by hand mixing or by mechanical means, eg using a heavy duty blender. Where the proportion of the polymer in the composition is low, ie of the order of 15–25% by weight of the total, the composition will have a relatively low viscosity, but at significantly higher proportions the composition may have a paste-like consistency. Generally it is preferred to operate at a higher proportion, say in the range 30% to 40% by weight, since under these conditions relatively little settlement of the polymer occurs if the composition is allowed to stand or is stored for some time prior to its being mixed with the liquid fuel. Suitable finely divided polymer may conveniently be obtained, in the case where the polymer is made by a process of aqueous emulsion polymerisation of monomer, by removal of the aqueous phase, eg by freeze drying or spray drying, but other methods may be employed such as precipitation of the polymer from solution or comminution of bulk polymer.

If the additional component is incorporated in a premixed liquid mixture as mentioned above, the composition comprising the mixture of polymer, hydroxylic carrier liquid, amine and additional component all as defined above is added to the liquid fuel under conditions of efficient mixing. Preferably an initial period of turbulent mixing into the fuel is followed by a period of more gentle agitation; under these conditions the blend is rapidly dispersed into the fuel. The addition may be carried out either batchwise or continuously: in view, however, of the interest in achieving effective modification of an aircraft fuel during a refuelling operation, continuous addition of the composition is particularly preferred.

A preferred composition suitable for use in or as a 'one-shot' anti-misting additive to aviation turbine fuel which is a liquid, mainly aliphatic, hydrocarbon fuel having a flash point not less than 90° F., includes the following components:

(i) a polymer as defined above to an extent of from 15% to 40% by weight of the composition;
(ii) an amine as defined above to an extent of from 0.01 to 0.2 mole based on each 100 g of the polymer taken;
(iii) the additional component as specified above to a total extent of between 0.1% and 5% by weight of the composition; and
(iv) a hydroxylic carrier liquid as defined above, making up the remainder of the composition.

Preferably, the composition is made by pre-mixing all of the liquid components (ii), (iii) and (iv) before adding these to the polymer (i).

Preferably, the composition when added to the aviation fuel is such that the polymer component forms not more than about 0.4% by weight of the fuel.

Preferably the composition is a paste having the following composition:

(i) about 30–40% by weight of polymer as defined above which is a copolymer of tert-butylstyrene, methyl methacrylate and methacrylic acid, (the exact polymer content being determined by the size distribution and structure of the finely-divided particles);
(ii) n-butylamine in that percentage by weight of the polymer which corresponds to about 70–75% of the weight percentage of methacrylic acid in the monomer mixture used in the polymer preparation;
(iii) about 0.5% by weight of water; formic acid in an amount of one quarter of the percentage by weight of n-butylamine may also be incorporated in addition to the water (if desired for a further improvement in dissolution rate and compatibility); and
(iv) 2-methylpentane-2,4-diol making up the remainder of the composition.

Preferably, in the method according to the present invention, including using the above mentioned composition, the polymer is a copolymer obtained from the copolymerisation of:

(i) (90-x)% by weight of tert-butylstyrene;
(ii) 10% by weight of methyl methacrylate; and
(iii) x% by weight of methacrylic acid; x being in the inclusive range 2 to 10, preferably from 5 to 7.

BRIEF DESCRIPTION OF THE DRAWINGS

Embodiments of the present invention will now be described by way of example with reference to the accompanying drawings in which.

Figure 1:
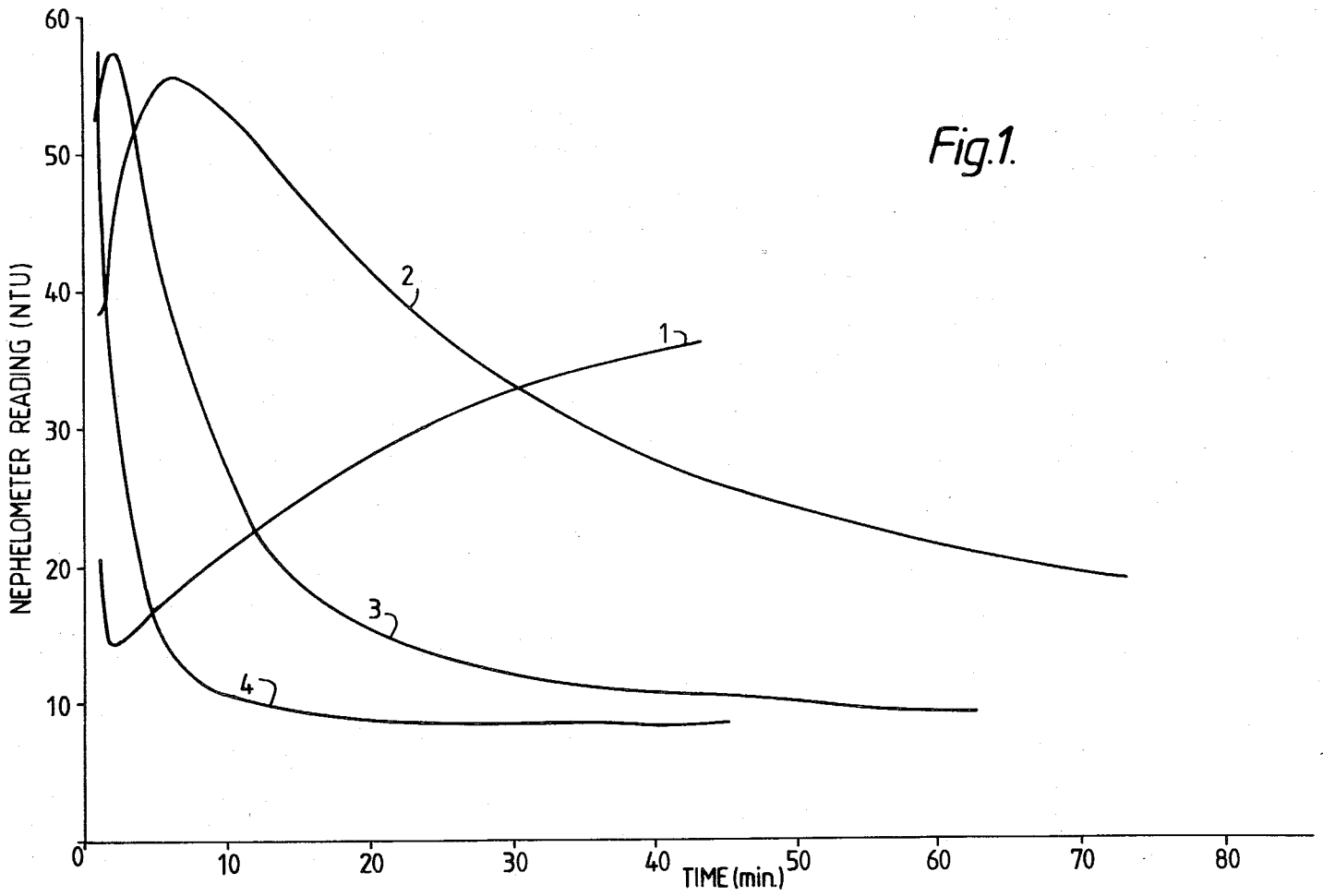
FIG. 1 is a graph illustrating the variation of the turbidity of freshly made paste/fuel blends with time, as determined by nephelometer.

In the following Examples, all parts, percentages and ratios given are by weight (unless otherwise stated).

EXAMPLE 1

An aqueous copolymer dispersion was prepared by polymerising a mixture of tert-butylstyrene, methyl methacrylate and methacrylic acid in the ratios 83:10:7 in the manner described in Example 1 of British Specification No. GB 2045778A, as follows.

To a polymerisation vessel fitted with nitrogen inlet extending below the liquid level there was charged:

Distilled water: 1152 parts
Acetone: 288 parts
Sodium dioctylsulphosuccinate: 9 parts This charge was stirred until the surfactant had completely dissolved. There was then added 360 parts of a pre-mixed charge of monomer having the composition tert-butylstyrene 83%, methylmethacrylate 10% and methacrylic acid 7%. The temperature of the reaction mixture was adjusted to 25° C. and a nitrogen sparge was started at the rate of 200 ml of nitrogen per minute per Kg of total charge. After nitrogen had been passed for 5 minutes, there was added in the order stated the following initiator charges, prepared immediately prior to addition by dissolving each solid in the water:

Ammonium persulphate: 0.18 part
Distilled water: 9 parts

Sodium dithionite: 0.3 part
Distilled water: 9 parts

The nitrogen flow rate was then reduced to 50 ml per minute per Kg of total charge, and the temperature was maintained within the range 25°–30° C. for a total period of 6 hours counted from the addition of the initiators, cooling as necessary in order to control the reaction exotherm. Finally there was added 18 parts of a 0.1% solution of n-octyl mercaptan and stirring the nitrogen flow were then discontinued.

The resulting aqueous copolymer emulsion was then spray-dried.

The copolymer, Powder 1, so formed when dispersed in and heated in AVTUR 50 fuel at 90°–100° C. to form a 0.3% solution, had a relative viscosity of 1.5 and a differential orifice flow of 5.05 ccs per 30 seconds.

Pastes of the following compositions were made by blending 32 parts of the same batch of spray-dried powder, Powder 1, with the stated liquids in a pre-mixed form, as follows:

Composition 1:
32 parts Powder 1, 66.4 parts 2-methylpentane-2,4-diol, 1.6 parts n-butylamine.

Composition 2:
32 parts Powder 1, 65.9 parts 2-methylpentane-2,4-diol, 1.6 parts n-butylamine, 0.5 parts distilled water.

Composition 3:
32 parts Powder 1, 66.0 parts 2-methylpentane-2,4-diol, 1.6 parts n-butylamine, 0.4 parts formic acid.

Composition 4:
32 parts Powder 1, 65.5 parts 2-methylpentane-2,4-diol, 1.6 parts n-butylamine, 0.5 parts distilled water, 0.4 parts formic acid.

The pastes were prepared at room temperature (20° C.) using a high torque mixer to ensure uniform mixing.

After ageing at ambient temperature for 4 hours each paste (Compositions 1 to 4) was blended by vigorous agitation over a 15-second period into AVTUR 50 fuel at 20° C. so as to give a 0.3% concentration of copolymer in the fuel in each case. The turbidity of each blend (Compositions 1 to 4 in fuel) was estimated using a Turner Designs nephelometer which showed that the turbidity values, in calibrated units, passed through a maximum with time, then descreased as the copolymer particles dissolved in fuel. The temperature of the fresh blends was maintained at 20° C. and they were gently agitated to ensure a homogeneous distribution of copolymer particles in the fuel. The time interval between the point of blending and the point at which the fuel blends showed maximum turbidity was measured for blends made from each of Compositions 1 to 4 and the results obtained are as listed in Table 1 as follows:

TABLE 1

| Time Interval between point of blending and point of Maximum Turbidity | |
|---|---|
| Composition | Time Interval (minutes) |
| 1 | >40 |
| 2 | 6 |
| 3 | 2 |
| 4 | 1 |

These time intervals in Table 1 may be taken as an inverse measure of the copolymer dissolution rate in the fuel and illustrate improved dissolution of copolymer in the fuel caused by addition of water (Composition 2), formic acid (Composition 3) or preferably both (Composition 4) to the basic paste (Composition 1).

The actual turbidity v time curves obtained for Compositions 1 to 4, the maxima being used to compile Table 1, are shown in the Composition numbers.

EXAMPLE 2

Further freshly-blended samples of the 0.3% copolymer/fuel blends prepared under the same conditions as in Example 1 from Compositions 1, 2 and 4 were allowed to age for 20 minutes at 20° C. without agitation. The fuel blend prepared from Composition 1 had become markedly inhomogeneous due to settling of partially swollen copolymer particles and so was not tested further. 1-kilogram samples of blends made from each of the other two blends were then stirred for 120 seconds in a 2-liter-capacity beaker of 11 cm diameter using a high-speed homogeniser operating at 10,000 rpm. During this treatment the fuel temperature increased significantly and mechanical degradation of the copolymer occurred. After cooling to 20° C. each degraded copolymer solution was immediately allowed to flow under gravity through a vertical glass tube of 2.3 cm internal diameter and 37 cm length filled to overflowing with the fuel, the lower end of which was plugged by a 16–18 micron stainless steel twilled Dutch weave filter element of warp diameter 0.07 mm (165 mesh) and weft diameter 0.04 mm (1400 mesh). The times taken for the meniscus of the degraded copolymer solutions to pass between marks set at 28 and 11 cm above the filter element were measured electronically and compared with the corresponding time for unmodified AVTUR 50 fuel at 20° C. to pass between the marks under the same conditions. The determinations for AVTUR 50 were undertaken immediately prior to those for the copolymer solutions, and an unused filter element was installed for each pair of determinations (AVTUR 50 followed by copolymer solution). For each copolymer/fuel blend the ratio of the flow time for copolymer solution to the AVTUR 50 flow time was calculated and this could be taken as a measure of the compatibility of the fuel with an aircraft fuel system at the time at which it was degraded. Thus the lower the ratio the less would be the likelihood of the fuel having an adverse effect on the performance of the filters, heat exchangers and engine spray nozzles of an aircraft fuel system. The results which were obtained for degraded copolymer blends made from Compositions 2 and 4 are listed in Table 2 as follows:

TABLE 2

| Ratio of flow time for fuel/copolymer blend to flow: time for fuel alone | |
|---|---|
| Composition included in fuel | Ratio |
| 2 | 10.2 |
| 4 | 2.5 |

It could be concluded that the presence of water and formic acid in the basic paste (Composition 1) improved the compatibility of freshly-blended copolymer solutions with an aircraft fuel system.

EXAMPLE 3

The procedure of Example 1 was repeated as described except that Compositions 1 to 4 were allowed to age for 2 months before being blended with AVTUR 50. The times taken for the copolymer/fuel blends made from each of the pastes to reach their maximum turbidity readings measured in the same way as in Example 1 are as listed in Table 3 as follows:

TABLE 3

| Time interval between point of blending of aged pastes and point of maximum turbidity | |
|---|---|
| Composition | Time |
| 1 | 17 |
| 2 | 3.5 |
| 3 | 1 |
| 4 | 1 |

Table 3 (when compared with Table 1) illustrates that ageing of the pastes improves dissolution rate.

EXAMPLE 4

The spray-dried copolymer powder produced as in Example 1, Powder 1, was made into the following further paste compositions by mixture with the appropriate liquids in a pre-mixed form Composition 5–20 parts Powder 1, 79 parts 2-methylpentane-2,4-diol, 1 part n-butylamine.

Composition 6–20 parts Powder 1, 78.5 parts 2-methylpentane-2,4-diol, 1part n-butylamine, 0.5 parts distilled water.

Composition 7–20 parts Powder 1, 78.25 parts 2-methylpentane-2,4-diol, 1 part n-butylamine, 0.5 part distilled water, 0.25 parts formic acid.

Compositions 5, 6 and 7 were then blended in AVTUR 50 fuel as in Example 1, to give 0.3% concentration of copolymer in the fuel in each case. Each of the separate blends so produced was then subjected to the same turbidity test as in Example 1 using the same nephelometer. The results which were obtained are given in Table 4 as follows:

TABLE 4

| Time interval between point of blending and point of maximum turbidity | |
|---|---|
| Composition | Time Interval (minutes) |
| 5 | >100 |
| 6 | 17 |
| 7 | 1 |

Table 4 illustrates that the dissolution rate improvement obtained by adding water and formic acid is obtained with a change in the basic paste composition (from Composition 1 in Example 1 to Composition 5 in Example 4).

EXAMPLE 5

Pastes of Compositions 2 and 4 prepared as in Example 1, were each metered in a continuous process at a rate of 22.5 grams per second into AVTUR 50 fuel flowing at a rate of 3 liters per second and at a temperature of 15°–18° C. The resulting copolymer/fuel blends were each subjected to mechanical shearing after various times in a device of the kind described in UK Patent Specification No. GB 2,000,983A at an energy input of 75 kilojoules per liter of blend. After shearing each fuel/paste blend, it was immediately cooled to 20° C. and subjected to the filter tests as described in Example 2 above. The ratios of flow times of copolymer solution: AVTUR 50 after the various times measured from the point of blending are as listed in Table 5 as follows:

TABLE 5

| Time after blending | Ratio for fuel/paste blend made from Composition 2 | Ratio for fuel/paste blend made from Composition 4 |
|---|---|---|
| 15 min | 18.5 | 5.6 |
| 30 min | 17.9 | 5.1 |
| 45 min | 16.3 | 3.9 |
| 1 day | 1.3 | 1.25 |

Table 5 illustrates that the incorporation of formic acid in the paste causes the resultant copolymer/fuel blend to be more compatible with an aircraft fuel system during the first hour after blending.

EXAMPLE 6

Paste of Composition 4, obtained as described in Example 1, was metered into a turbulent flow of AVTUR 50 fuel at 34° C. so as to give a 0.3% concentration of copolymer in the fuel. The fuel/paste blend was transferred to a 10-gallon capacity tank, fitted to a rocket-propelled sled. Fifteen minutes after introducing the copolymer paste into the fuel, the sled was fired along a track into arrester gear at 88 meters per second, and the fuel blend, at a temperature of 34° C., was ejected through an array of ignition souces. No ignition of the fuel blend occurred. The blending of paste of Composition 2 into AVTUR 50 and testing in a similar manner gave a similar result but when unmodified AVTUR 50 fuel was similarly tested, a large fire-ball resulted.

EXAMPLE 7

A copolymer was prepared by aqueous emulsion polymerisation of a mixture of tert-butylstyrene, methyl methacrylate and methacrylic acid in the ratios 85:10:5 as follows:

To a polymerisation vessel fitted with nitrogen inlet extending below the liquid level there was charged:

Distilled water: 1480 parts

Sodium dioctylsulphosuccinate: 18 parts

This charge was stirred until the surfactant had completely dissolved. There was then added 360 parts of a pre-mixed charge of monomer having the composition tert-butyl styrene 85%, methyl methacrylate 10% and methacrylic acid 5%. The temperature of the reaction mixture was adjusted to 30° C. and a nitrogen sparge was started at the rate of 200 ml of nitrogen per minute per Kg of total charge. After nitrogen had been passed for 5 minutes, there was added in the order stated the following initiator charges, prepared immediately prior to addition by dissolving each solid in the water:

Ammonium persulphate: 0.36 parts

Distilled water: 9 parts

Ascorbic acid: 0.6 parts

Distilled water: 9 parts

The nitrogen flow rate was then reduced to 40 ml per minute per Kg of total charge, and the temperature was maintained within the range 28°–32° C. for a total period of 6–8 hours counted from the addition of the initiators, cooling as necessary in order to control the reaction exotherm. Finally, there was added 18 parts of a 0.1% solution of n-octylmercaptan in water/acetone (80:20) and stirring was continued for 5 minutes.

The resulting 20% aqueous copolymer emulsion was then spray-dried, to form a powder-Powder 2. This powder after dispersion in and heating in AVTUR 50 at 90°–100° C. to form a 0.3% solution, had a relative viscosity of 1.5 and a differential orifice flow rate of 4.47 ccs per 30 seconds.

Pastes of the following compositions were made by blending 32 parts of the same batch of spray-dried powder with the premixed liquids as follows:

Composition 8

32 parts Powder 2, 6685 parts 2-methylpentane-2,4-diol, 1.15 parts n-butylamine.

Composition 9

32 parts Powder 2, 6635 parts 2-methylpentane-2,4-diol, 1.15 parts n-butylamine, 0.5 part distilled water.

Composition 10

32 parts Powder 2, 66.05 parts 2-methylpentane-2,4-diol, 1.15 parts n-butylamine, 0.5 part distilled water, 0.3 part formic acid.

After ageing at ambient temperature for 4 hours each paste was blended by vigorous agitation over 15 seconds into AVTUR 50 at 20° C. so as to give a 0.15% concentration of copolymer in the fuel in on each case. The turbidity of the blends after various times was measured as described in Example 1 and the time interval was measured between the point of blending and the point at which each copolymer/fuel blend developed maximum turbidity. The results which were obtained are as given in Table 7 as follows:

TABLE 7

Time interval between point of blending and point of maximum turbidity

| Composition | Time Interval |
|---|---|
| 8 | 16 |
| 9 | 5 |
| 10 | <1 |

Table 7 illustrates that the improvement in dissolution obtained by adding water and formic acid is obtained with a change in the copolymer of the basic paste composition (from Composition 1 to Composition 8).

EXAMPLE 8

Compositions 1 and 2 were prepared as in Example 1, together with further compositions prepared from the same powder batch, Powder 1, containing 1% and 2% of water as follows:

Composition 11

32 parts Powder 1, 65.4 parts 2-methylpentane-2,4-diol, 1.6 parts n-butylamine, 1 part distilled water.

Composition 12

32 parts Powder 1, 64.4 parts 2-methylpentane-2,4-diol, 1.6 parts n-butylamine, 2 parts distilled water.

Figure 2:
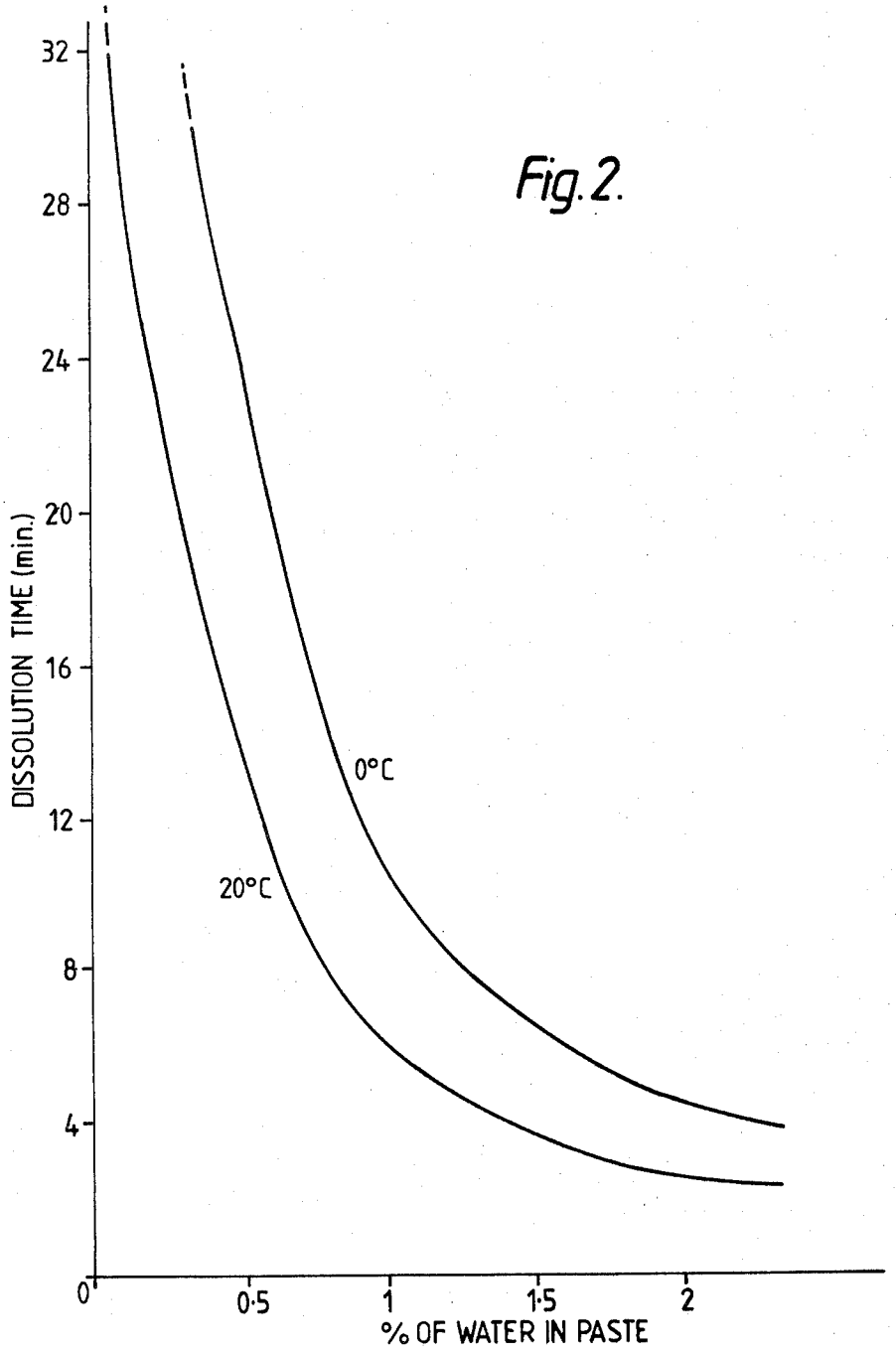
FIG. 2 is a graph illustrating the effect of water on the dissolution rate of a polymer additive in aviation fuel.

After ageing at ambient temperature for the same time, each paste was separately blended with AVTUR 50 fuel as in Example 1 at temperatures of 0° C. and 20° C. The times taken for the copolymer particles to dissolve in the fuel were noted at each temperature and the results obtained are shown in Table 8 and in FIG. 2.

TABLE 8

Effect of the amount of water on dissolution time

| Composition | % water | Dissolution time at 20° C. | Dissolution time at 0° C. |
|---|---|---|---|
| 1 | 0 | >5 hours | >5 hours |
| 2 | 0.5 | 14 min | 24 min |
| 11 | 1 | 6 min | 10.5 min |
| 12 | 2 | 2.5 min | 4.5 min |

It is clearly seen that at both temperatures, the dissolution time of the basic paste, Composition 1, is shortend as the percentage of water present increases.

For the basic paste, Composition 1, little dissolution occurs at all, the copolymer particles tending to form aggregates which settle in the fuel.

In practice it is preferable not to increase the water content above about 1.25% to avoid the formation of a separate aqueous phase in the fuel. Preferably the water content is about 0.5% of the paste.

Similar improvements in dissolution time were obtained when the same pastes were blended with liquid hydrocarbon fuels of aromatic contents other than 18 volume percent. In practice, fuels of aromatic content less than 10% by volume should be avoided because dissolution of copolymer in these is slow and settling of copolymer particles occurs.

EXAMPLE 9

A carrier fluid comprising water, n-butylamine, acetic acid and 2-methylpentane-2,4-diol was prepared and added to the same copolymer of t-butylstyrene as used in Example 1, ie Powder 1, in the proportions shown in Table 9 as follows, to form Composition 13.

TABLE 9

Composition 13

| Component | Proportion (% by weight) |
|---|---|
| Water | 0.5 |
| n-butylamine | 1.6 |
| Acetic acid | 1.3 |
| 2-methylpentane-2,4-diol | 64.6 |
| Powder 1 | 32 |

In order to achieve a uniform dispersion of the polymer in the carrier fluid a high torque mixer was used. The composition was prepared at about 20° C. (room temperature). When the polymer had been uniformly dispersed in the carrier fluid a portion of the composition constituting a freshly made anti-misting paste additive was mixed with AVTUR 50 aviation fuel using a high-shear homogeniser so that the polymer component constituted about 0.3% by weight of the fuel.

Subsequent tests similar to those described in Examples 1 and 2, with the fuel/anti-misting additive mixture (Composition 13) showed that the rate of dissolution of the additive in the fuel was such that the additive dissolved in the fuel within 10 minutes at 20° C., as estimated by nephelometer. Under the same conditions, a sample of Composition 2 took at least 30 minutes to dissolve. Likewise, Composition 13 had less tendency to block test filters than Composition 2, under similar conditions. Fire tests of blends of Composition 13 in aviation fuel showed that fire resistance was achieved over a range of temperatures by 15 minutes after the additive had been blended into the fuel.

EXAMPLE 10

The following compositions were parepared by a similar method to that used in Example 9:

Composition 14:

32 parts Powder 1 65.9 parts 2-methylpentane-2,4-diol, 1.6 parts n-butylamine, 0.5 part glycerol; and Composition 15

32 parts Powder 1, 65.9 parts 2-methylpentane-2,4-diol, 1.6 parts n-butylamine, 0.5 part ethylene glycol.

After these and Composition 1 had all aged for the same time, each paste was blended into AVTUR 50 at 20° C. so as to form a 0.3% mixture of the polymer in the fuel. Their relative dissolution times, as estimated by nephelometer are as shown in Table 10:

TABLE 10

Effect of glycerol, ethylene glycol on dissolution

| Composition | Relative Dissolution Time |
|---|---|
| 1 | >5 hours |
| 14 | 1 hour |
| 15 | 4 hours |

The presence of glycerol or ethylene glycol therefore afforded some improvement in the dissolution rate of Powder 1 in AVTUR 50 at 20° C.

I claim:

1. A method for dissolving in a liquid, mainly aliphatic, hydrocarbon fuel having a flash point not less than 90° F. an additive comprising:

(a) from about 30% to about 40% by weight of a polymer in finely divided form which is a copolymer of (i) at least 75% by weight of tert-butylstyrene, (ii) from 1% to 24% by weight of a second monomer selected from the acrylic and methacrylic esters of aliphatic monohydric alcohols containing from 1 to 4 carbon atoms, 2-ethoxyethyl methacrylate, acrylonitrile, vinyl acetate, styrene and vinyltoluene, and (iii) from 1% to 10% by weight of methacrylic acid, the aggregate of monomers (i), (ii) and (iii) being 100%, the polymer having the following characteristics:

(1) it is soluble in AVTUR 50 aviation kerosene;

(2) a 0.3% by weight solution of the polymer in AVTUR 50 aviation kerosene has a relative viscosity in the range of 1.25 to 2.6 and a differential orifice flow rate in the range 2.5 to 7 ccs per 30 seconds;

(b) from about 0.01 to about 0.2 mole per 100 grams of the polymer of an organic amine selected from the group consisting of alkyl monoamines having 1 to 12 carbon atoms, alkanolamines containing from 4 to 10 carbon atoms, and heterocyclic atoms; and (c) a hydroxylic carrier liquid making up the remainder of the additive which in the presence of the amine does not dissolve the polymer or is at most only a weak swellant for the polymer, the hydroxylic carrier liquid comprising 2-methylpentane-2,4-diol;

the concentration of the polymer in the fuel being in the inclusive range from 0.055 to 1% by weight, wherein the improvement comprises additionally adding to the fuel, so that there is present in the fuel when the said additive has been added to it, an additional component comprising one or more compounds selected from the following:

(I) water: to an extent of from 0.1% to 1.25% by weight of the additive plus the additional component;

(II) glycerol: to an extent of from 0.1% to 1.25% by weight of the additive plus the additional component;

(III) ethylene glycol: to an extent of from 0.1% to 2% by weight of the additive plus the additional component; and (IV) a straight chain aliphatic carboxylic acid having 1–4 carbon atoms present to an extent of from 10% to 200% molar equivalent of the amount of amine present.

2. A method as in claim 1 and wherein the additional component is added together with the said additive.

3. A method as in claim 2 and wherein a liquid mixture is formed by mixing the hydroxylic carrier liquid, the amine and the additional component and the liquid mixture is mixed with the polymer to form a composition which is added to the fuel in a single addition step.

4. A method as claimed in claim 1 and wherein the amine is n-butylamine.

5. A method as claimed in claim 1 and wherein the additional component comprises water.

6. A method as claimed in claim 5 and wherein the additional component comprises an acid selected from formic acid and acetic acid.

7. A method as claimed in claim 5 and wherein the additional component comprises water plus formic acid.

8. A method as claimed in claim 1 and wherein the said composition comprises:

(i) from about 30% to about 40% by weight of a polymer as defined in claim 1 which is a copolymer of tertbutylstyrene, methyl methacrylate and methacrylic acid;

(ii) n-butylamine in a percentage by weight of the polymers which corresponds to about 70% to 75% of the weight percentage of methacrylic acid in the monomer mixture from which the polymer is prepared;

(iii) about 0.5% by weight of water;

(iv) 2-methylpentane-2,4-diol making up the remainder of the composition.

9. A method as claimed in claim 8 and wherein the composition additionally includes formic acid in an amount of one quarter of the percentage by weight of n-butylamine.

10. A method as claimed in claim 8 and wherein the polymer is a copolymer obtained from the copolymerisation of:

(i) (90-x)% by weight of tert-butylstyrene;

(ii) 10% by weight of methyl methacrylate;

(iii) x% by weight of methacrylic acid; where x is in the inclusive range 2–10;

11. A method as claimed in claim 1 and wherein the fuel has an aromatic content of not less than 10 percent by volume.

12. A method as claimed in claim 1 and wherein the organic amine is primary alkyl monoamine having from 3 to 10 carbon atoms.

* * * * *